US005551101A

United States Patent [19]

Leach

[11] Patent Number: 5,551,101

[45] Date of Patent: Sep. 3, 1996

[54] BATH MAT FOR USE IN BATHING OTHERS

[76] Inventor: Sheryl S. Leach, 2603 Foxboro, McKinney, Tex. 75070

[21] Appl. No.: 9,769

[22] Filed: Jan. 27, 1993

[51] Int. Cl.[6] ..... A47K 3/02

[52] U.S. Cl. ..... 4/580; 4/571.1

[58] Field of Search ..... 4/559, 571.1, 572.1, 4/578.1, 579, 580, 581, 582, 583

[56] References Cited

U.S. PATENT DOCUMENTS

| | | | |
|---|---|---|---|
| D. 163,757 | 6/1951 | Kirby | 4/572.1 X |
| 1,726,753 | 9/1929 | Mirkin | 4/572.1 |
| 2,296,592 | 9/1942 | Baxter et al. | 4/551 |
| 2,461,744 | 2/1949 | Lafield | 4/572.1 X |
| 2,483,077 | 9/1949 | Walsh | 4/579 X |
| 2,507,848 | 5/1950 | Bashaw | 4/572.1 |
| 3,591,867 | 7/1971 | Bernstein | 4/579 |
| 3,648,690 | 3/1972 | Miller et al. | 4/583 X |
| 4,625,344 | 12/1986 | Howard | 4/581 |
| 4,937,897 | 7/1990 | Barnabie | 4/580 |

FOREIGN PATENT DOCUMENTS

| | | | |
|---|---|---|---|
| 3134256 | 3/1983 | Germany | 4/580 |
| 2199740 | 7/1988 | United Kingdom | 4/571.1 |

OTHER PUBLICATIONS

The Right Start Catalog, Spring, 1992, Winter 1992 and Winter 1993 p. 51, item D250.

One Step Ahead Catalog, Holiday 1992 and Winter/Spring 1993, p. 26, item g.

*Primary Examiner*—Robert M. Fetsuga

*Attorney, Agent, or Firm*—Elizabeth R. Hall; Kelly K. Kordzik; Winstead Sechrest & Minick

[57] ABSTRACT

A bath mat is disclosed that provides a portable device for converting a typical bathtub into a safe, more user-friendly environment for bathing infants/preschoolers or individuals with impaired mobility. The bath mat provides both a system for catching fluids that splash over a top rim of the bathtub while bathing and a padded surface to cover the top rim of the bathtub to ease discomfort of the parent or care giver who must lean over the bathtub. The bath mat is designed so that attachments, for the convenience and entertainment of the bather and the care giver (such as toys, cartoon characters, brushes, etc.), can be removably attached to the bath mat. In addition, the bath mat provides surfaces for receiving the buttocks and head of individuals who may require support from a caregiver.

3 Claims, 4 Drawing Sheets

BATH MAT FOR USE IN BATHING OTHERS

TECHNICAL FIELD OF THE INVENTION

The present invention relates to a bath mat and more particularly to a bath mat adapted for use in bathing infants/preschoolers, or individuals with compromised mobility.

BACKGROUND OF THE INVENTION

Modern bathtubs are designed for the use of persons who are fully mobile and who can safely bathe themselves. Thus the average bathtub is not designed for bathing infants/preschoolers or individuals with limited or compromised mobility. Thus even when one works out a convenient system for bathing an infant/preschooler at home, the same bathing process can become extremely difficult whenever one has to stay at a hotel or with relatives.

For example, bathing an infant/preschooler in a bathtub will inevitably lead to a wet, and probably sudsy, bathroom floor. In addition, infants/preschoolers like to play with toys, etc. while they bathe and it is unsafe for the parent, or care giver, to leave ,yen for an instant to retrieve an item from elsewhere. Furthermore, the parent, or care giver, must lift the infant/preschooler totally out of the bathtub before beginning the drying off process because the side of the bathtub is very slippery when wet and an infant/preschooler could be injured if he/she were to fall. Finally, a typical bathtub provides a very uncomfortable environment for the parent, or care giver, who must lean over the bathtub while bathing the infant/preschooler. The top rim of the bathtub is cold and hard and pinches the care giver's underarms and chest throughout the bathing process.

Accordingly, a need exists for an economical, portable means of converting a typical bathtub into a safer, more user friendly environment for bathing infants/preschoolers or other individuals with compromised mobility.

Therefore an object of the present invention is to provide a portable and self-contained means of rendering a bathtub suitable for bathing infants/preschoolers or individuals with limited mobility.

Another object of the invention is to protect the bathroom floor from the liquids that splash over the side of the bathtub while bathing an infant/preschooler, providing both a safety and cosmetic benefit to the caregiver, and home.

An additional object of the invention is to provide a means of attaching items to the bath mat that can subsequently be easily removed, either for the parent's use or for the infant's/preschooler's use or entertainment. For an infant/toddler/preschooler, bathtime is one of the most enjoyable times of the day. The invention enhances the entertainment and educational aspects of bathtime.

Yet another object of the invention is to provide a padded and non-slip surface to cover the top rim of the bathtub for the safety of the infant/preschooler in getting out of the bathtub and for the comfort of the parent while bathing the infant/preschooler.

A further object of the invention is to provide a bath mat that is economical to manufacture, easy to clean, and convenient to store when not in use.

SUMMARY OF THE INVENTION

The problems discussed above have been solved in the present invention which provide a portable, self-contained means for converting a typical bathtub into a safe, more user friendly environment for participants in the bathing process.

Participants in the bathing process include infants/preschoolers or individuals with impaired or compromised mobility that are being bathed and the parent or caregiver assisting the bather.

The present invention is a bath mat that fits over the top rim of a bathtub with its sides extending downward, one side on the outside of the bathtub and one side on the inside of the bathtub. Preferred embodiments of the present invention have an external flap (i.e., the side of the bath mat that hangs on the outside of the bathtub) that is designed to collect and contain fluids that spill over the bathtub during bathing, as for example, a pocket along the outside edge of the bath mat. The internal flap (i.e., the side of the bath mat that hangs on the interior of the bathtub) may be decorated with scenes, cartoon characters, or caricatures of animals. These decorations may be permanently embodied in the bath mat or they may be removable and exchangeable. In addition, the internal flap may have hooks or rings attached to it in order to keep toys or other items readily accessible to the bather.

Furthermore, the top section of the bath mat (i.e., the section that is positioned over the top rim of the bathtub when the bath mat is in use) may be padded to provide a more comfortable surface for the parent or care giver to lean over during the bathing process. Preferred embodiments of the present invention are further designed to provide a safer bathing environment for an infant/preschooler or individuals with compromised mobility. The bath mat increases the safety of the bathing experience by providing padded areas with rough or ridged surfaces to increase traction thereby reducing the chance of falling and the degree of injury if an individual did fall.

Accordingly, one feature and technical advantage of the invention is that it is made of a flexible material that can be easily cleaned, rolled up like a bedroll, and conveniently stored or transported when not in use.

Another feature and advantage of the present invention is that it will prevent the bathroom floor from becoming a slippery, hazardous surface by catching the sudsy liquids that splash over the top rim of the bathtub.

An additional feature and advantage of the invention is that it provides a means for localizing items needed for the bathing process within a parent's reach, so that it is unnecessary to leave the bathing infant/preschooler to retrieve an item from elsewhere.

Yet another feature and advantage of the invention is that it provides padded surfaces that can fit in the bottom of the bathtub or over the top rim of the bathtub that can decrease the risk of falling and diminish the severity of an injury if a fall were to occur.

These and further features and advantages of the invention will be apparent from the following description of the preferred embodiments thereof.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The problems discussed above, inherent in bathing infants/preschoolers or individuals with compromised mobility, have been solved in several embodiments of the present invention as described below.

Figure 1:
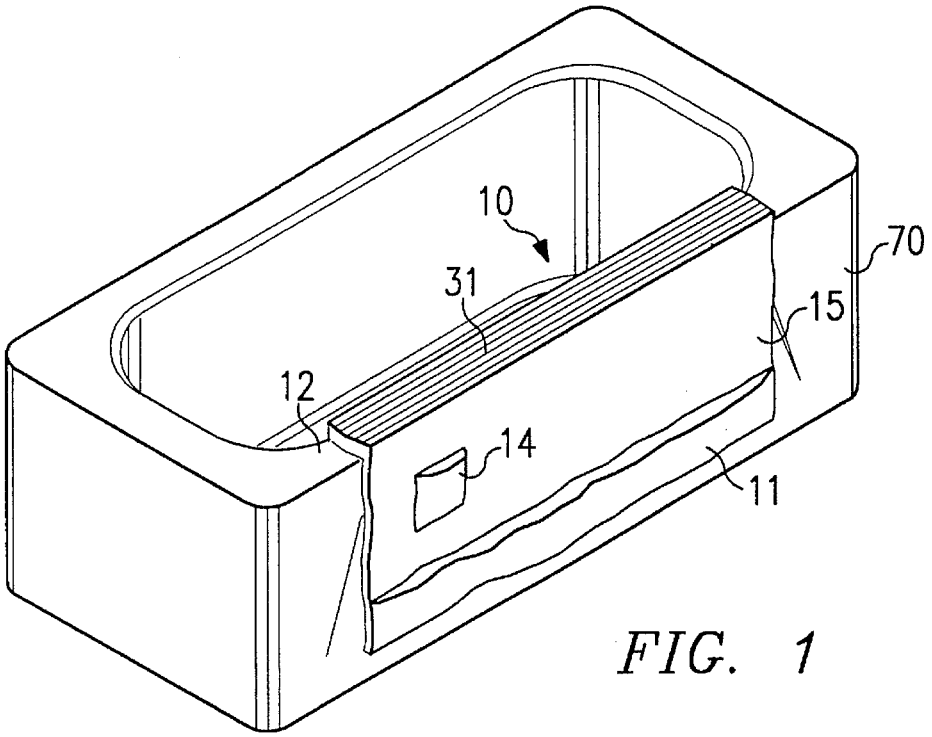
FIG. 1 shows an outside isometric view of one embodiment of the bath mat as it fits over a side of a bathtub.

FIG. 1 shows external flap 15 of bath mat 10 as it is positioned over top rim 12 of bathtub 70. As will be detailed hereinafter, top section 31 of bath mat 10 is, in a preferred embodiment, padded so as to remove or decrease the discomfort felt by a person leaning over rim 12 to care for a child (or adult) in bathtub 70.

Attached to external flap 15 is a means of collecting and containing overflow liquids, for example an adaptation to the outside edge of bath mat 10 to form pocket 11. Pocket 11 is designed to catch overflow fluids so as to protect the bathroom floor. Pocket 11 may be formed by or a permanent part of bath mat 10 or it may be detachable. Pocket 11 may also be designed with a drain to divert the overflow fluids to a desired location.

Preformed receptacle 14 may also be attached to external flap 15 to hold shampoo, sponges, etc. Alternatively, a preformed receptacle may also be attached to an internal flap, not shown in FIG. 1 but discussed under FIG. 2. Such a receptacle would be particularly helpful for a bather with limited mobility by serving as a repository for medications, soap, shampoo, etc. External flap 15 may have multiple pockets, receptacles, hooks, rings, etc. for attaching or storing useful items for the bathtub.

Figure 2:
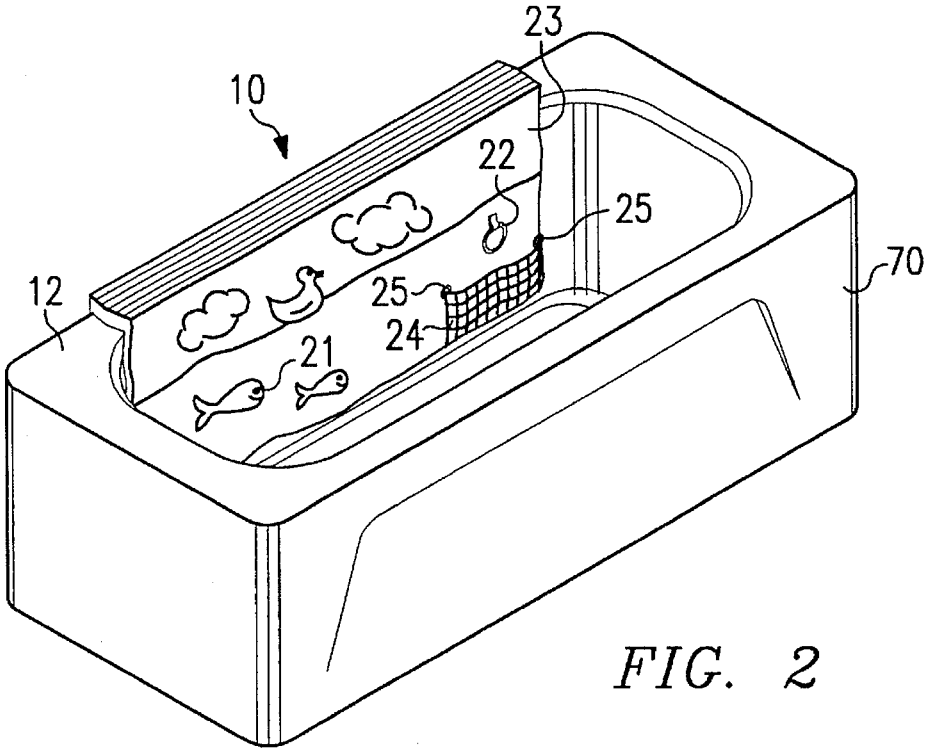
FIG. 2 shows an isometric view of one embodiment of the bath mat, from inside the bathtub, as it fits over the side of a bathtub.

FIG. 2 shows internal flap 23 of bath mat 10 as it is positioned over top rim 12 of bathtub 70. Internal flap 23 provides a means for removably associating items with bath mat 10, either for the parent's use or for the infant/preschooler's entertainment. For example, hook 22 may be attached to internal flap 23 in order to keep toys or other items readily accessible to the inside of the bathtub. Net 24 can be attached to internal flap 23 by rings 25, or by other devices. Net 24 can be used to store toys, etc.

Internal flap 23 and/or external flap 15 of bath mat 10 may be decorated with scenes, cartoon characters, or pictures of animals (including those that make a sound or series of sounds when poked or prodded). These decorations may form a permanent part of bath mat 10 or they may be removable and exchangeable. For instance, internal flap 23 may have a portion of its surface that is designed to stick to a portion of the surface of exchangeable item 21 by the well-known hook and loop mechanism.

Figure 3:
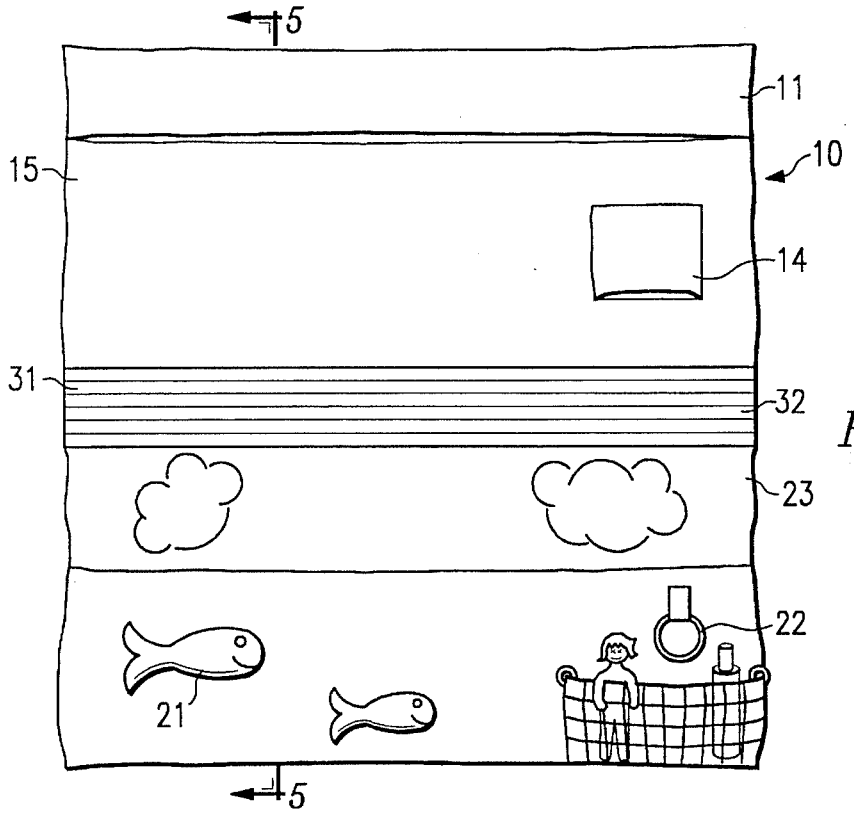
FIG. 3 shows a top side view of the bath mat when laid out flat.
Figure 5:
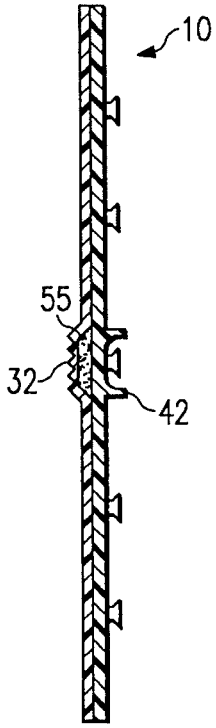
FIG. 5 shows a cross-section of the bath mat taken along Section 5—5 of FIG. 3.

FIG. 3 shows the top of the bath mat as if the bath mat were laid out flat. Top section 31 of bath mat 10 is located between and adjoins external flap 15 and internal flap 23. Top section 31 fits over top rim 12 of bathtub 70 as illustrated in FIGS. 1 and 2. Top section 31 may be padded and, if desired, ridged as illustrated in FIG. 5. Padding (not shown), described further below, traverses the width of top section 31 and provides a more comfortable surface for the parent to lean over during the bathing process. In one embodiment of the invention, ridged surface 32, in juxtaposition to the padding (not shown), also traverses the width of top section 31. Ridged surface 32 decreases the risk that an infant/preschooler will fall, or that a person with compromised mobility might slip, if he/she was to sit on top section 31 during the drying off process. In addition, ridged surface 32, or any other type of friction-enhancing surface, provides traction to assist a bather from slipping while standing up. Furthermore, bathtub attachments that are made to fit over the side of a bathtub that provide support for persons needing help to get in and out of a bathtub can fit directly over bath mat 10. A strap or other device could also be attached to bath mat 10 to hold an infant or an impaired person in place.

Figure 4:
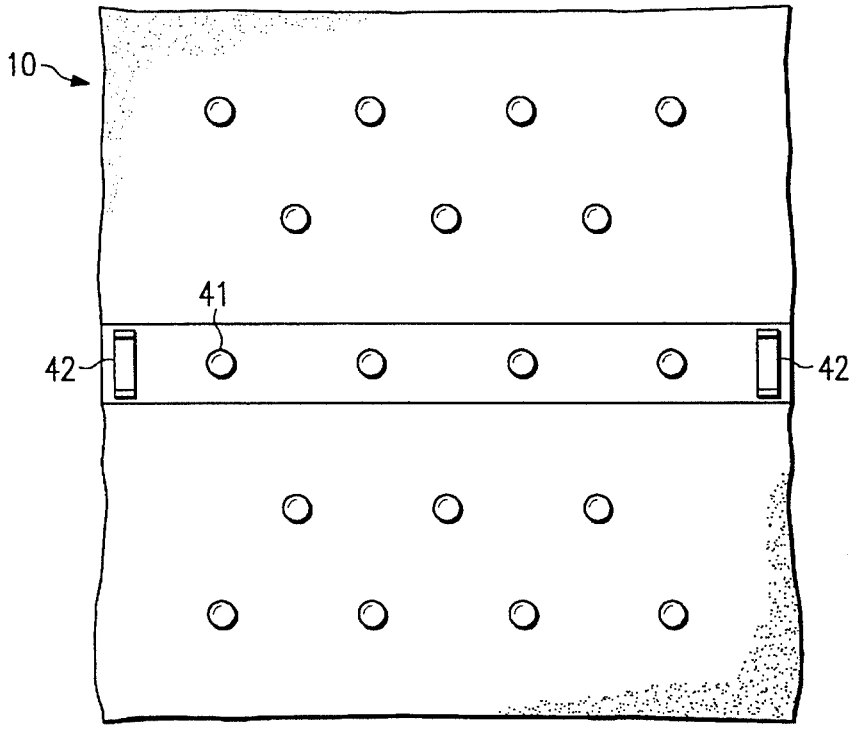
FIG. 4 shows an underside view of the bath mat when laid out flat.

FIG. 4 shows an underside of bath mat 10 which has a limited, essentially non-slip surface, for example shown as comprising suction cups 41. This non-slip surface may cover the entire surface of bath mat 10 by reason of the material from which it is manufactured, or because of the presence of an applied material that provides a non-slip surface coextensive with the underside of bath mat 10. Providing a nonslip surface on the underside of bath mat 10 will help keep the bath mat in place even when a parent leans over it or when an infant/preschooler holds on to it while standing up.

In addition, FIG. 4 shows, attached to the underside of top section 31, a mounting device 42 designed to fit over top rim 12 and further stabilize bath mat 10 when it is positioned over top rim 12 of bathtub 70. Mounting device 42 is further described under FIG. 5.

FIG. 5 shows a cross-section of bath mat 10 taken along Section 5—5 of FIG. 3. Although the entire bath mat 10 may be padded, FIG. 5 shows a preferred embodiment of bath mat 10 in which padding 55 traverses the width of bath mat 10 along top section 31 for the comfort of the parent or care giver who must lean over top rim 12 of bathtub 70 of FIG. 1 during the bathing process. Padding 55 may be designed to slip out, if desired, so that it can be renewed from time to time. In addition, FIG. 5 illustrates an embodiment in which ridged surface 32, in juxtaposition to padding 55, also traverses the width of top section 31. These features are designed to provide a safer bathing experience by reducing the chance of falling and the degree of injury if an individual did fall.

FIG. 5 also shows that bath mat 10 may have attached to the underside of top section 31, a means 42 for holding bath mat 10 in place. For example, mounting device 42 could be designed to fit over top rim 12 to further stabilize bath mat 10 when positioned over the side of bathtub 70. Mounting device 42 may be preformed and a permanent part of bath mat 10, or it may represent a separate attachment that can be inserted into bath mat 10 and used as desired. Mounting device 42 may traverse the width of top section 31, or it may be located in areas close to each side of the bath mat as illustrated in FIG. 4.

Figure 6:
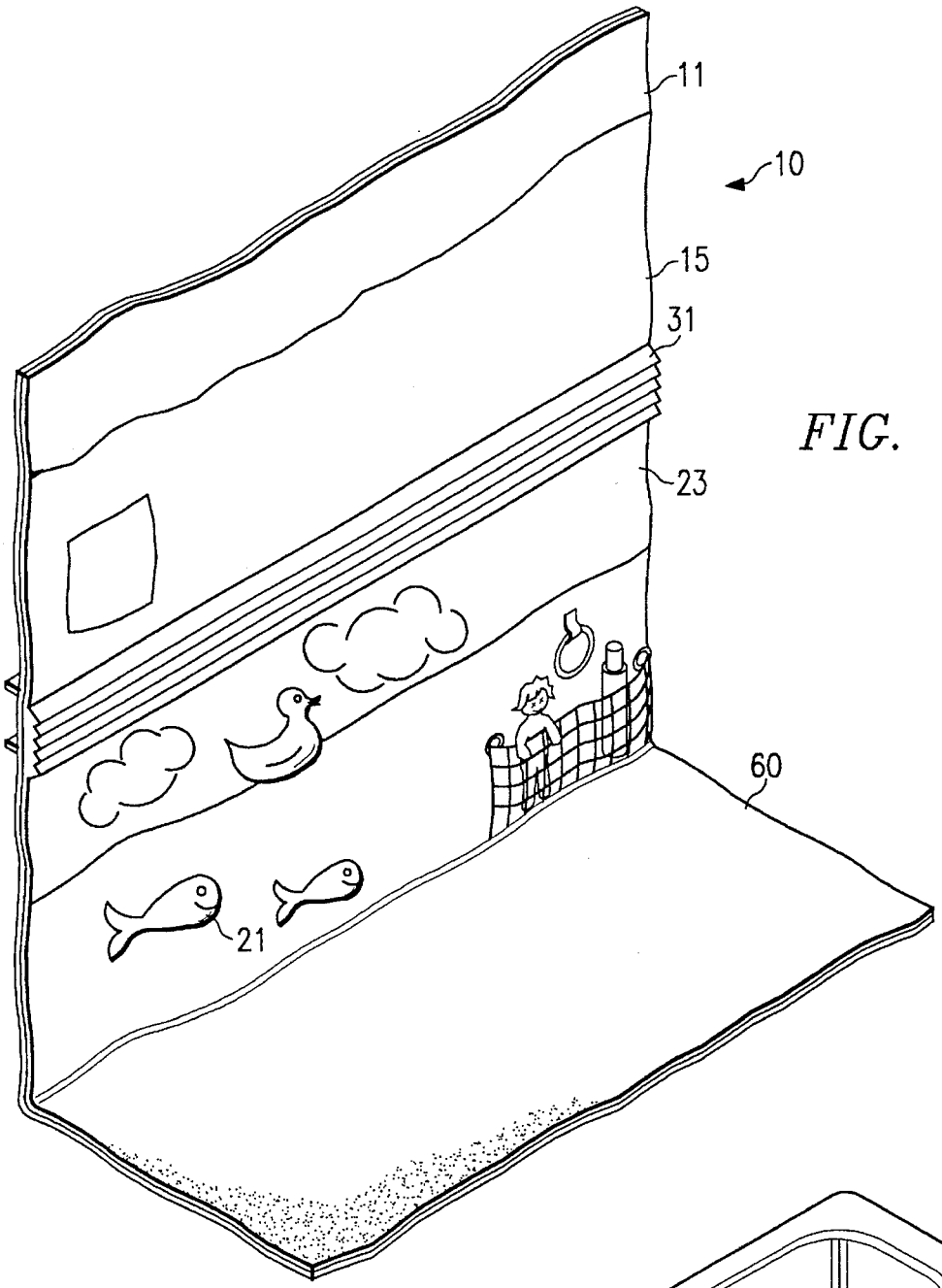
FIG. 6 shows an isometric view of a padded section that covers the bottom of the bathtub.

FIG. 6 shows bath mat 10 with bottom section 60 designed to fit the bottom of bathtub 70. Bottom section 60 can be padded and also can have a non-slip surface on either or both of its surfaces to further decrease the risk of falling and to further decrease the seriousness of any potential injury if the bather does fall.

Figure 7:
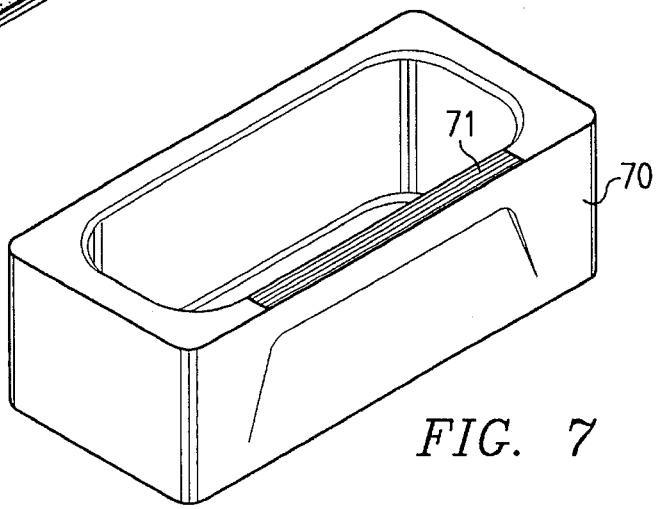
FIG. 7 shows an isometric view of the bathtub that is adapted to accept the bath mat.

FIG. 7 shows bathtub 70 adapted to accept bath mat 10 of FIG. 1. Adaptation 71 of top rim 12 of bathtub 70 increases the stability and ease with which bath mat 10 can be positioned with respect to bathtub 70. Adaptation 71 is designed to work in conjunction with mounting device 42 of bath mat 10 in order to positively couple bath mat 10 to bathtub 70.

It should be noted that external flap 15 can be omitted by those who desire not to have their bathing area appear modified. In such a situation, flap 15 can be omitted permanently, or it can be attachable at bath time, or it can be designed to roll up. This would yield a "clean" outer surface to tub 70.

Adaptation 71 may represent an area along top rim 12 of bathtub 70 with a surface texture or composition that will interact with mounting device 42 to increase the stability of bath mat 10 when positioned over top rim 12 of bathtub 70. For example, adaptation 71 may represent a surface area that is magnetized, or designed to stick to the underside of bath mat 10 by the well-known hook and loop mechanism. However, adaptation 71 may also represent a means of inserting and locking mounting device 42 into place on bathtub 70, such as threaded holes to accept a mounting device 42 that is threaded.

Figure 8:
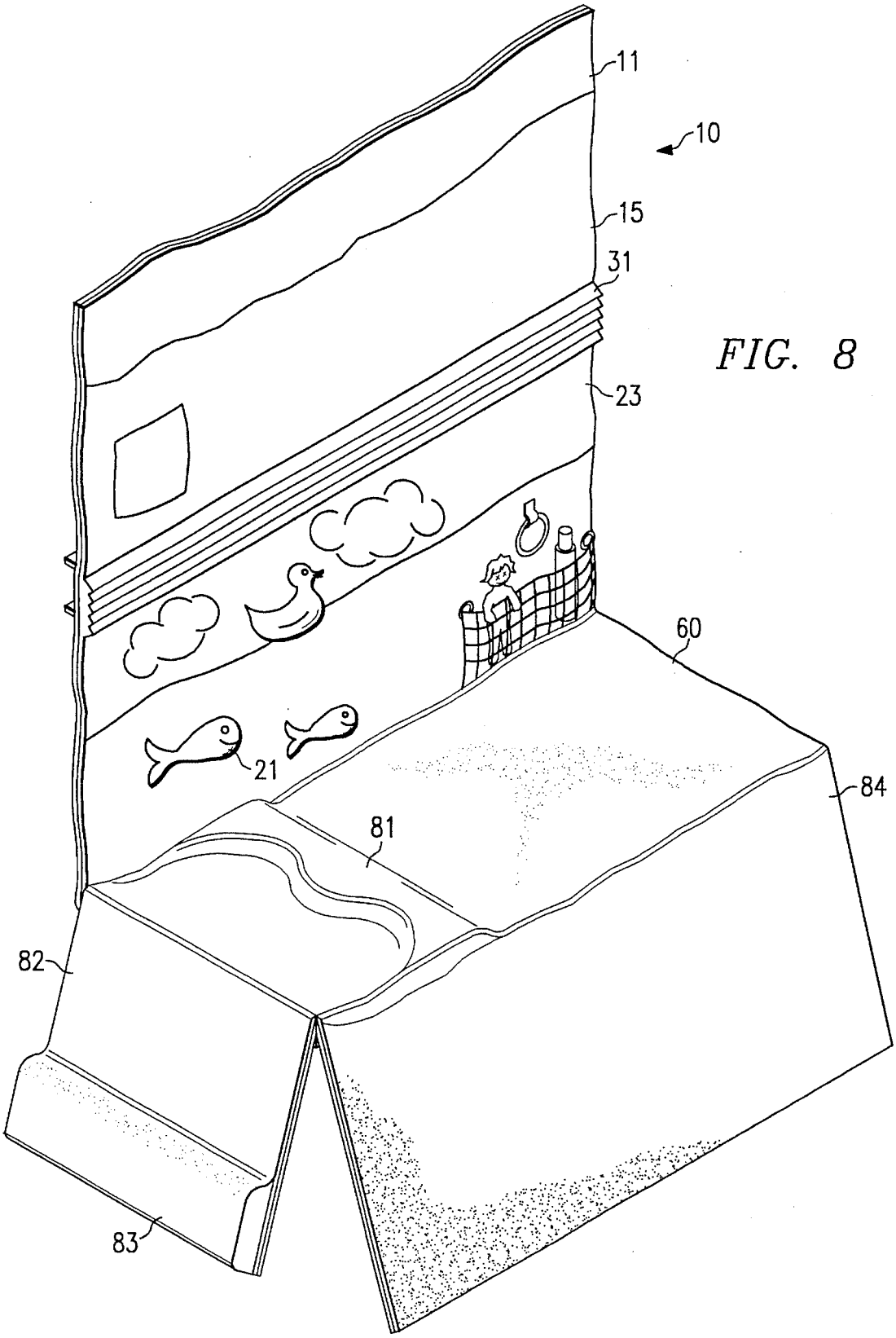
FIG. 8 shows an alternate embodiment having a tub bottom section molded to assist the bathing process.

FIG. 8 shows another embodiment of the invention wherein molded seat 81 is designed for the buttocks of the person being bathed. This embodiment is particularly useful for bathing those children (or adults) who must be continuously supported by the caregiver.

Seat 81 can be padded as desired and flap 82 can be added, also with padding 83 for the head area, if desired. This will provide the bather with a soft and warm surface to lean against. Surfaces 60, 81, 82 and 83 could be molded to fit the human body, thus acting to provide both a comfortable bathing platform as well as a movement restraining system.

Bath mat 10 advantageously may be made of a flexible material so that it can be rolled up for storage when not in use or for traveling. Therefore, bath mat 10 can easily be carried from one place to another and be readily accessible to convert a regular bathtub into an environment that is safer and more user friendly for bathing infants/preschoolers or individuals with compromised mobility.

While preferred embodiments of the invention have been shown and described, it will be apparent to those skilled in the art that the conception and the specific embodiments disclosed may be readily utilized as a basis for modifying or designing other structures for carrying out the same purpose as the present invention. It should also be realized by those skilled in the art that such equivalent constructions do not depart from the spirit and scope of the invention as set forth in the appended claims.

What is claimed is:

1. A bath mat for use over a top rim of a bathtub, said mat comprising:

a limited-slip surface on a portion of an underside of said mat;

means for collecting liquid spilled from said bathtub, said collecting means attached to an external flap of said mat; and a mounting device located on said underside of said mat that is sized to fit into an adaptation of said bathtub.

2. A bath mat for use on a top rim of a bathtub, comprising:

a limited-slip surface on a portion of an underside of said mat;

a padded section traversing a portion of a width of said mat, said padded section adapted to be positioned on said top rim of said bathtub;

a means for collecting liquid spilled from said bathtub, said collecting means attached to a section of said mat external to said bathtub and restrained by said padded section; and a mounting device located on said underside of said mat adapted to fit into an adaptation of said bathtub.

3. A bath mat for use over a top rim of a bathtub, said mat comprising:

a limited-slip surface on the underside of said mat;

a padded section traversing a portion of a width of said mat, said padded section adapted to be positioned over said top rim of said bathtub;

a traction-enhancing surface traversing a portion of a width of an upper side of said mat and in juxtaposition with said padded surface;

means for removably attaching objects to a section of said mat;

means for collecting liquid spilled from said bathtub, said collecting means attached to an external flap on said mat; and a mounting device located on said underside of said mat for interacting with an adaptation on a rim of said bathtub.

* * * * *

UNITED STATES PATENT AND TRADEMARK OFFICE

CERTIFICATE OF CORRECTION

PATENT NO. : 5,551,101

DATED : September 3, 1996

INVENTOR(S) : Sheryl S. Leach

It is certified that error appears in the above-indentified patent and that said Letters Patent is hereby corrected as shown below:

Column 1, line 22: Replace ", yen" with --even--.

Signed and Sealed this

Twentieth Day of May, 1997

*Attest:*

Bruce Lehman

BRUCE LEHMAN

*Attesting Officer*

*Commissioner of Patents and Trademarks*